US010722933B2

(12) United States Patent
Rodermund-Gebhart et al.

(10) Patent No.: US 10,722,933 B2
(45) Date of Patent: Jul. 28, 2020

(54) RING-ROLLING MACHINE AND METHOD FOR LIFTING AND LOWERING THE MANDREL ROLL OF A RING-ROLLING MACHINE

(71) Applicant: SMS group GmbH, Duesseldorf (DE)

(72) Inventors: Felix Rodermund-Gebhart, Moenchengladbach (DE); Dirk Kalkhoff, Moenchengladbach (DE)

(73) Assignee: SMS Group GmbH, Duesseldorf (DE)

( * ) Notice: Subject to any disclaimer, the term of this patent is extended or adjusted under 35 U.S.C. 154(b) by 328 days.

(21) Appl. No.: 15/420,370

(22) Filed: Jan. 31, 2017

(65) Prior Publication Data

US 2017/0225222 A1 Aug. 10, 2017

(30) Foreign Application Priority Data

Feb. 4, 2016 (DE) ..... 10 2016 101 939

(51) Int. Cl.
*B21H 1/12* (2006.01)
*B21H 1/06* (2006.01)

(52) U.S. Cl.
CPC ..... *B21H 1/12* (2013.01); *B21H 1/06* (2013.01)

(58) Field of Classification Search
CPC .. B21H 1/06; B21H 1/12; B21D 53/16; B21B 5/00
USPC ..... 72/105–111
See application file for complete search history.

(56) References Cited

U.S. PATENT DOCUMENTS

| | | | | |
|---|---|---|---|---|
| 4,339,937 | A | 7/1982 | Strugala et al. | |
| 7,500,374 | B2 | 3/2009 | Martins et al. | |
| 8,365,564 | B2 | 2/2013 | Hirose et al. | |
| 8,689,597 | B2 | 4/2014 | Hirose et al. | |
| 10,065,234 | B2 | 9/2018 | Bolik | |
| 2012/0279268 | A1 | 11/2012 | Loveless et al. | |
| 2015/0290689 | A1 | 10/2015 | Bolik | |
| 2015/0290700 | A1* | 10/2015 | Bolik | B21H 1/06 72/12.8 |

FOREIGN PATENT DOCUMENTS

| | | | |
|---|---|---|---|
| CN | 201217014 | Y | 4/2009 |
| CN | 202398621 | U | 8/2012 |
| CN | 203917752 | U | 11/2014 |
| DE | 29 23 001 | C2 | 11/1989 |
| DE | 10 2014 005 332 | A1 | 10/2015 |
| JP | S56-165507 | A | 12/1981 |
| JP | H02-200342 | A | 8/1990 |
| JP | H09-276911 | A | 10/1997 |

(Continued)

OTHER PUBLICATIONS

Vinzant et al. WO 2009147359 A1, Tranlation 2009.*

(Continued)

*Primary Examiner* — Adam J Eiseman
*Assistant Examiner* — Bobby Yeonjin Kim
(74) *Attorney, Agent, or Firm* — Collard & Roe, P.C.

(57) ABSTRACT

In a ring-rolling machine having a mandrel roll and a related radial roll, the mandrel roll can be handled in operationally reliable and structurally simple manner if an axial bearing of the mandrel roll is opened by way of an opening drive that does not rotate along with the mandrel roll and/or is closed by inserting the mandrel roll into the axial bearing.

8 Claims, 4 Drawing Sheets

(56) References Cited

FOREIGN PATENT DOCUMENTS

| | | | | |
|---|---|---|---|---|
| JP | 2008-254070 | | 10/2008 | |
| JP | 4702369 | B2 | 6/2011 | |
| JP | 5383881 | B1 | 1/2014 | |
| KR | 10-2015-0118044 | A | 10/2015 | |
| KR | 10-2015-0118050 | A | 10/2015 | |
| WO | 2007/114174 | A1 | 10/2007 | |
| WO | 2009/147359 | A1 | 12/2009 | |
| WO | WO-2009147359 | A1 * | 12/2009 | ..... B21H 1/06 |

OTHER PUBLICATIONS

German Office Action dated Sep. 23, 2016 in German Application No. 10 2016 101 939.9 with English translation of relevant parts.
Chinese Office Action in CN 201710064484.X, dated Jul. 23, 2018.

* cited by examiner

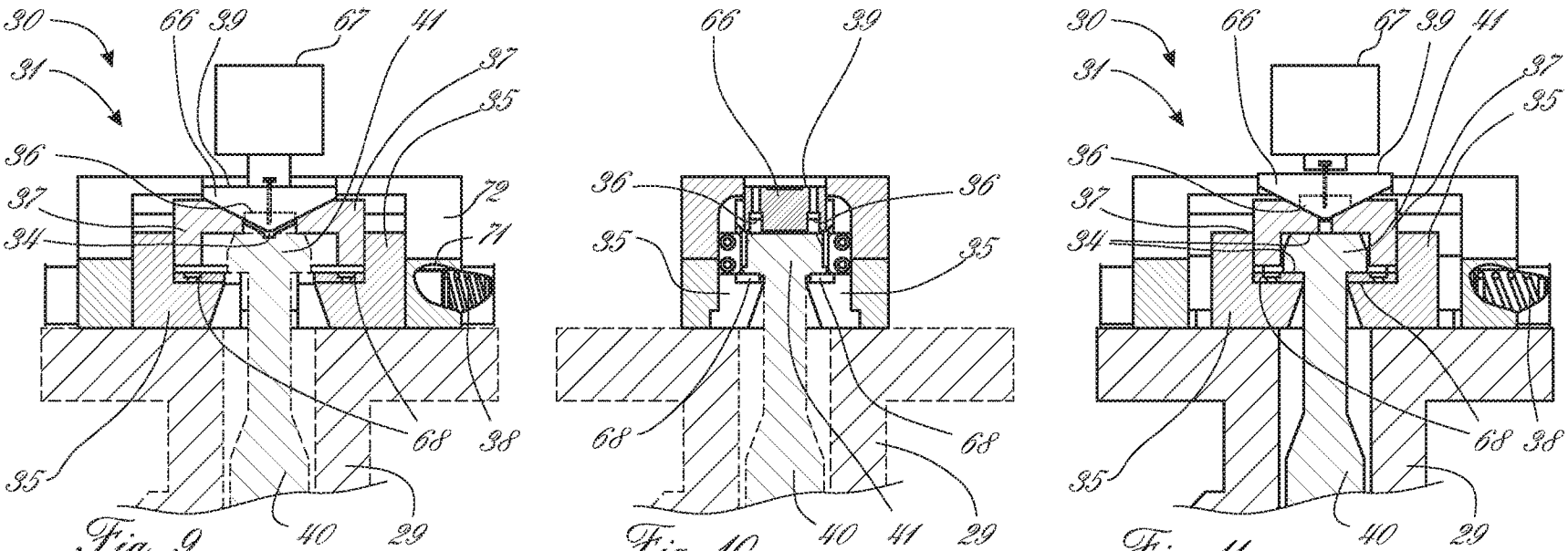
Fig. 9
Fig. 10
Fig. 11
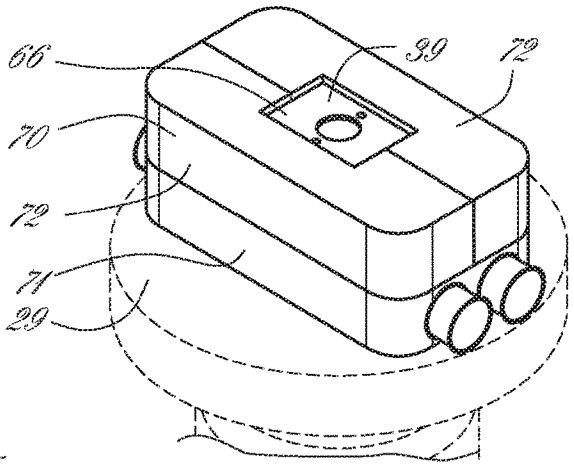
Fig. 12
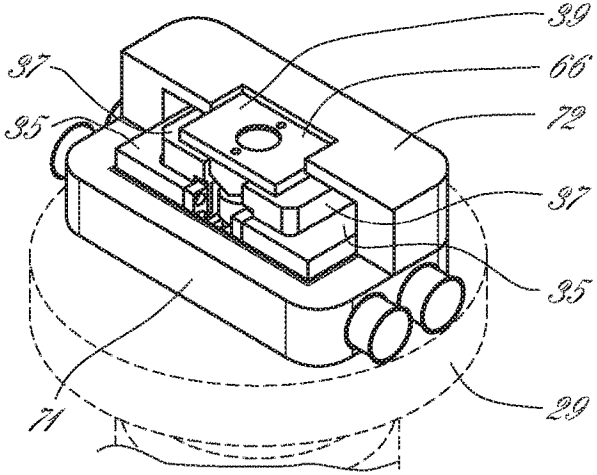
Fig. 13

RING-ROLLING MACHINE AND METHOD FOR LIFTING AND LOWERING THE MANDREL ROLL OF A RING-ROLLING MACHINE

CROSS REFERENCE TO RELATED APPLICATIONS

Applicant claims priority under 35 U.S.C. § 119 of German Application No. 10 2016 101 939.9 filed on Feb. 4, 2016, the disclosure of which is incorporated by reference.

BACKGROUND OF THE INVENTION

Field of the Invention

The invention relates to a ring-rolling machine having a mandrel roll and a related radial roll, wherein the mandrel roll is mounted in an upper and in a lower mandrel roll bearing, the upper mandrel roll bearing is configured as a fixed bearing, the fixed bearing has both a radial bearing and an axial bearing, the axial bearing encompasses a mandrel roll head of the mandrel roll and supports it at the bottom, and the axial bearing is configured so that it can be opened by way of opening means. Likewise, the invention relates to a method for lifting and lowering the mandrel roll of a ring-rolling machine configured in such a manner. Corresponding ring-rolling machines are sufficiently known from the state of the art, in many different respects.

SUMMARY OF THE INVENTION

It is the task of the present invention to make available a ring-rolling machine of the stated type and a method of the stated type for lifting and lowering the mandrel roll of a ring-rolling machine, in which the mandrel roll can be handled in operationally reliable and structurally simple manner.

The task of the invention is accomplished by means of a ring-rolling machine as well as a method for lifting and lowering the mandrel roll of a ring-rolling machine, having the characteristics of the independent claims. Further advantageous embodiments, also independent of these, are found in the dependent claims and in the following description.

In this regard, the invention proceeds from the fundamental recognition that operationally reliable handling of the mandrel roll can be guaranteed in structurally simple manner by means of mechanical measures with which the mandrel roll and the modules that stand in interaction with the mandrel roll are provided. If suitably designed, the mechanical measures can be implemented doing without additional control lines and the like, in this regard, and this particularly leads to increased operational reliability.

Thus, the mandrel roll can be handled in an operationally reliable and structurally simple manner, by a ring-rolling machine having a mandrel roll and a related radial roll, in which the mandrel roll is mounted in an upper and a lower mandrel roll bearing. The upper mandrel roll bearing is configured as a fixed bearing and the fixed bearing has both a radial bearing and an axial bearing. The axial bearing encompasses a mandrel roll head of the mandrel roll and supports it at the bottom, and the axial bearing is configured so that it can be opened by way of opening means having locking elements that prevent opening if the mandrel roll is not supported. Likewise, the mandrel roll can be handled in an operationally reliable and structurally simple manner, by a method for lifting and lowering the mandrel roll of a ring-rolling machine having a mandrel roll and a related radial roll, wherein the mandrel roll is mounted in an upper and a lower mandrel roll bearing, the upper mandrel roll bearing is configured as a fixed bearing, the fixed bearing has both a radial bearing and an axial bearing, the axial bearing encompasses a mandrel roll head of the mandrel roll and supports it at the bottom, and the axial bearing is configured so that it can be opened by way of opening means where opening of the axial bearing is prevented if the mandrel roll is not supported.

Thus, the locking elements can have at least one ratchet system, for example, on which the mandrel roll comes to rest and which is connected to interact with a locking latch. As long as the locking latch or the locking elements are closed, opening of the axial bearing is then effectively prevented.

In this regard, the locking elements can be held in their position in any effective manner. This can take place by means of form fit, for example, which locks the locking elements as long as the mandrel roll is not supported at the bottom. For example, such form fit can be guaranteed between a groove on an underside of a mandrel roll head and corresponding projections on the locking elements that engage into the groove, because then, if the mandrel roll is supported, the projections of the locking elements can depart from the groove by being lifted slightly, and then the hindrance by the locking elements is released. It is understood that here, tongue and groove can also be interchanged, so that the groove or corresponding recesses can be provided in the locking elements or in the locking latch, and corresponding projections can be provided in the mandrel roll head. Alternatively and preferably, the locking elements can have a locking effect by way of force fit or friction fit. In this regard, the friction fit can lock the locking elements in place when the opening means are supposed to be activated, wherein the force fit or friction fit can then be released by means of lifting the mandrel roll or relieving it of stress, in such a manner that the locking elements or the locking latch is/are released and the opening means can be opened.

In this connection, it should be emphasized that in general, the lower mandrel roll bearing is selected to be a floating bearing, and preferably only has a radial bearing. This makes it possible, as is already sufficiently known from the state of the art, to align the mandrel roll, in the vertical direction, in different operating positions that are disposed to differ vertically, particularly in order to be able to carry the ring-rolling process out in flexible manner and with different vertical positions of the mandrel roll. For this purpose, the upper mandrel roll bearing is generally disposed in a bearing body that can be displaced vertically, accordingly, within an operating range.

Accordingly, it might be sufficient if the upper mandrel roll bearing is configured as a fixed bearing and has an axial bearing that supports the mandrel roll merely at the bottom, if the mandrel roll is then ultimately axially fixed in place sufficiently by means of gravity. Preferably, the upper mandrel roll bearing is configured as a fixed bearing and has an axial bearing that supports the mandrel roll at the top and at the bottom, in order to be able to absorb the operating forces that occur during operation in operationally reliable manner, in every case, in both directions.

Operationally reliable handling of the mandrel roll can also be guaranteed, in a structurally simple manner, in the case of a ring-rolling machine having a mandrel roll and a related radial roll, if the mandrel roll is mounted in an upper and a lower mandrel roll bearing, the upper mandrel roll bearing is configured as a fixed bearing, the fixed bearing has both a radial bearing and an axial bearing, the axial bearing encompasses a mandrel roll head of the mandrel roll and supports it at the bottom, and the axial bearing is configured so that it can be opened by way of opening means, and if the opening means have blocking elements that prevent closing if no mandrel roll is present in the region of the axial bearing. Likewise, the mandrel roll can be handled in an operationally reliable and structurally simple manner if a method for lifting and lowering the mandrel roll of a ring-rolling machine having a mandrel roll and a related radial roll, wherein the mandrel roll is mounted in an upper and a lower mandrel roll bearing, the upper mandrel roll bearing is configured as a fixed bearing, the fixed bearing has both a radial bearing and an axial bearing, the axial bearing encompasses a mandrel roll head of the mandrel roll and supports it at the bottom, and the axial bearing is configured so that it can be opened by way of opening means, where closing the axial bearing is prevented if no mandrel roll is present in the region of the axial bearing. In this manner, the opening means remain open until a mandrel roll is present in the region of the axial bearing, and as a result, the blocking elements release the opening means and allow closing of the axial bearing.

In this regard, the blocking elements as well as the locking elements can be configured as mechanical components. This allows a particularly operationally reliable construction.

The blocking elements can then be released by or by means of the mandrel roll itself and thereby release the opening means.

The presence of the blocking elements particularly facilitates introducing a mandrel roll into the axial bearing, for example after setup or maintenance measures, such as in the case of a mandrel roll change, for example. Because of the fact that the opening means are held open by the blocking elements, introducing the mandrel roll into the axial bearing is significantly facilitated, and accordingly, this increases operational reliability.

The blocking elements can have at least one latch contact point on which the mandrel roll comes to rest and which is connected to interact with a blocking latch. If the mandrel roll therefore comes into contact with the latch contact point of the blocking elements, it can act accordingly on a blocking latch or on the blocking elements, and cancel out the blocking.

The locking elements can also have a latch contact point, as already explained above, on which the mandrel roll comes to rest and which is connected to interact with a locking latch, wherein here, the latch contact point is configured in such a manner that the locking latch is held in its locking position by means of the contact between mandrel roll and latch contact point of the locking elements.

Preferably, the opening means also comprise an opening drive, by means of which the axial bearing can be opened. In particular, a hydraulic or pneumatic drive or an electric motor, for example, can be used as an opening drive, which acts on modules of the opening means that can open and close accordingly. In this regard, a wedge, for example, can act as modules that can open and close, which wedge acts on latches or clamps and interacts directly or indirectly, preferably by way of the latches or wedges, with the locking elements or the blocking elements.

In particular, the opening means can comprise an opening drive that does not rotate along with the mandrel roll, which drive can act on a drive plate that opens the axial bearing and rotates along with the mandrel roll. In the case of a suitable configuration, this allows doing without cost-intensive and failure-susceptible ducts. In this regard, the drive plate is preferably disposed on the axis of rotation of the mandrel roll, so that although it can rotate, its position in space remains in place.

Thus, the axial bearing can be opened by way of an opening drive that does not rotate along with the mandrel roll, and this allows doing without cost-intensive and failure-susceptible ducts in the case of a suitable configuration. Cumulatively or alternatively, the axial bearing can be closed by inserting the mandrel roll, so that no separate drive needs to be provided for this purpose. The mandrel roll can therefore be handled in operationally reliable manner, cumulatively or alternatively, in structurally simple manner, even independent of the other characteristics of the present invention, in the case of a ring-rolling machine having a mandrel roll and a related radial roll, if the mandrel roll is mounted in an upper and a lower mandrel roll bearing, the upper mandrel roll bearing is configured as a fixed bearing, the fixed bearing has both a radial bearing and an axial bearing, the axial bearing encompasses a mandrel roll head of the mandrel roll and supports it at the bottom, and the axial bearing is configured so that it can be opened by way of opening means, and if the axial bearing is opened by way of an opening drive that does not rotate along with the mandrel roll and/or by inserting the mandrel roll into the axial bearing.

The mandrel roll can be handled in operationally reliable manner, cumulatively or alternatively, in a structurally simple manner, in the case of a ring-rolling machine having a mandrel roll and a related radial roll, if the mandrel roll is mounted in an upper and a lower mandrel roll bearing, the upper mandrel roll bearing is configured as a fixed bearing, the fixed bearing has both a radial bearing and an axial bearing, the axial bearing encompasses a mandrel roll head of the mandrel roll and supports it at the bottom, and the axial bearing is configured so that it can be opened by way of opening means, and if the mandrel roll bearing is disposed on a bearing body that can be lifted and lowered, which body is guided by way of an operating guide that guides the bearing body vertically in a vertical operating region, and by way of a discharge guide that guides the bearing body in a vertical discharge region. Likewise, the mandrel roll can be handled in operationally reliable and structurally simple manner, by means of a method for lifting and lowering the mandrel roll of a ring-rolling machine having a mandrel roll and a related radial roll, wherein the mandrel roll is mounted in an upper and in a lower mandrel roll bearing, the upper mandrel roll bearing is configured as a fixed bearing, the fixed bearing has both a radial bearing and an axial bearing, the axial bearing encompasses a mandrel roll head of the mandrel roll and supports it at the bottom, and the axial bearing is configured so that it can be opened by way of opening means, and if a bearing body on which the upper mandrel roll bearing is disposed and which is guided by way of an operating guide that vertically guides the bearing body in a vertical operating region, and by way of a discharge guide that guides the bearing body in a vertical discharge region, and guidance of the bearing body between the operating guide and the discharge guide is handed over when the bearing body leaves the operating region or enters into it again.

The combination of the operating guide and the discharge guide makes it possible for the first time that the mandrel roll can be mounted in a sufficiently stable manner, without additional construction measures, between different vertical operating positions, and nevertheless can be brought into a discharge position by means of the transition to the discharge guide, in which position a workpiece replacement, if applicable also a mandrel roll replacement or other manipulations of the mandrel roll can be carried out in simple and operationally reliable manner. A mandrel roll replacement can take place in that the mandrel roll is first lowered to its lowest position in the operating guide and supported at the bottom, so that opening the axial bearing can take place, wherein subsequently, the upper mandrel roll bearing or the bearing body is lifted and the mandrel rod becomes accessible. In particular, it is not necessary to provide additional modules or actually a separate lifting apparatus here, such a cranes or specially retrofitted forklifts. Ultimately, lifting and lowering can be carried out with any available lifting apparatus, which is also used otherwise for lifting and lowering the upper mandrel roll bearing or the bearing body.

Preferably, the operating guide is configured to be narrower than the discharge guide. This guarantees that the bearing body—and consequently also the mandrel roll—is guided more precisely in the region of the operating guide, in order to guarantee precise positioning of the mandrel roll in the operating region and, in particular, also when dipping into the lower mandrel roll bearing, while the discharge guide, with its greater play, allows simple and operationally reliable lifting and lowering of the mandrel roll, even over greater heights, if this is desired.

In this regard, the operating guide can be configured as a plate guide or by way of slide shoes, for example, and can also provide clamping or a clamping possibility or a clamping unit, if necessary, by means of which the bearing body and thereby also the mandrel roll can additionally be fixed in place in a desired position along the operating guide. This particularly serves for operationally reliable positioning of the mandrel roll in the region of the operating guide during ring-rolling operation, so that in this regard, a lifting apparatus, which is provided for vertical displacement, if necessary, does not need to become effective.

However, an operational guide in which guidance takes place by way of rollers or rolling bodies as guide elements serves for a similar purpose; this allows even better guidance properties if clamping separate from the actual guidance is provided, which clamping can be implemented, for example, by means of clamping bodies and clamping elements. In this regard, it is understood that if necessary, modules of the operating guide can also be used as clamping bodies or clamping elements.

Preferably, the bearing body and consequently also the mandrel roll are clamped during operation, and this allows stable and operationally reliable mounting of the mandrel roll, and rapid release for displacement along the operating guide. In this regard, clamping can be made possible, in the case of a suitable configuration of the operating guide or in the case of a suitable configuration of the related clamping means, within an operating region covered by the operating guide, so that then different operating positions can be approached within the operating region. In this regard, the operating region can correspond, if applicable, to the guide length of the operating guide, preferably minus a transition region to the discharge guide.

Accordingly, the mandrel roll of a ring-rolling machine having a mandrel roll and a related radial roll, in which the mandrel roll is mounted in an upper and a lower mandrel roll bearing, the upper mandrel roll bearing is configured as a fixed bearing, the fixed bearing has both a radial bearing and an axial bearing, the axial bearing encompasses a mandrel roll head of the mandrel roll and supports it at the bottom, and the axial bearing is configured so that it can be opened by way of opening means, can be handled in operationally reliable manner, cumulatively or alternatively, in structurally simple manner, by means of a method for lifting and lowering the mandrel roll of a ring-rolling machine having a mandrel roll and a related radial roll, using a bearing body on which the upper mandrel roll bearing is disposed and which is guided by way of a discharge guide that guides the bearing body in a vertical discharge region, wherein the bearing body is clamped in place during operation.

This clamping can take place, in a structurally particularly simple manner, by means of the operating guide itself, in that this guide, which is preferably already configured to be very narrow, is further narrowed by way of a clamping device or by way of similar measures, until sufficiently high clamping forces occur. Preferably, however, clamping is provided supplemental to the operating guide, which can be correspondingly clamped by way of a clamping drive and also opened again. For this purpose, corresponding clamping elements and clamping bodies, for example, which can be brought into interaction with one another, can be provided.

The discharge guide in turn can be guaranteed by way of a roller guide or also by way of a slide guide, wherein here, ultimately cost considerations and wear must be taken into consideration. Here, in general, correspondingly precise guidance is not significant, because only low demands are made regarding the positioning of the mandrel roll or of the bearing body in the discharge region, which preferably corresponds to the guide length of the discharge guide, if applicable minus an overlap to the operating region.

Preferably, as has already been explained above, the guide lengths of the operating guide and of the discharge guide overlap, so that in every position of the bearing body, sufficient guidance of the bearing body is guaranteed. In this regard, threading or a threading apparatus of the operating guide can be provided, particularly in the region of the overlap, wherein the threading or the threading apparatus extends over a specific guide length of the operating guide, and within this expanse of the threading apparatus, the operating guide is configured to be constantly narrower in the direction of the operating guide. In this manner, the bearing body with its respective guide bodies can be captured by the operating guide at the transition from the threading guide to the operating guide, whereas it is displaced in the direction of the operating guide in the relatively wide discharge guide. As it leaves the operating guide, the bearing body is then transferred to the discharge guide in correspondingly gentle manner.

Preferably, guide bodies both for the operating guide and for the discharge guide are disposed on the bearing body, which can also be configured in multiple pieces, if necessary. This arrangement has a relatively simple construction, particularly if the bearing body has an essentially one-piece configuration, and brings about the result that the guide bodies are found in a fixed spatial relationship with one another.

The bearing body has an advantageously low construction if the guide bodies of the operating guide, i.e. their guide length, overlap horizontally with the guide bodies of the discharge guide, i.e. their guide length, in other words are disposed vertically at the same height at least in partial regions; in the end result, this also means that the discharge guide must have the lowest possible construction above the remainder of the ring-rolling machine.

On the basis of the geometrical configuration of the mandrel roll, with a shaft that ultimately is supposed to be vertically displaceable in the lower mandrel roll bearing, the operating guide is preferably disposed in a vertical operating guide plane that is oriented parallel to this shaft. In this manner, the mandrel roll can easily be displaced along the operating guide and a corresponding ring-rolling process can be carried out in every position—aside from a possible threading region or aside from possible threading or a threading apparatus.

Because the mandrel roll departs from the lower mandrel roll bearing in the case of upward displacement, starting from a specific vertical height, it is not absolutely necessary that the discharge guide lies strictly in a vertical discharge guide plane, although this can be implemented very easily in terms of construction. Purely theoretically, the guide path of the discharge guide can also follow an inclined or curved guide path when the mandrel roll has departed from the lower mandrel roll bearing or the operating guide, if applicable aside from a threading region or an overlap.

Preferably, the operating guide plane and the discharge guide area are at a distance from one another, so that sufficient construction space remains for the modules that belong to the operating guide and the discharge guide, in each instance, and these do not hinder one another.

Particularly preferably, the mandrel roll lies in the operating guide plane, so that guidance in the region of the operating guide or in the operating region is guaranteed to be relatively symmetrical to the mandrel roll, and this therefore guarantees very stable guidance during ring rolling. This is not necessary for the discharge guide, because here only insignificant forces are applied.

Preferably, the ring-rolling machine has a lifting apparatus for the bearing body that can be lifted and lowered, so that the bearing body can be easily displaced along the operating guide and/or along the discharge guide. Depending on the concrete embodiment, two lifting apparatuses can be used, if necessary, which are each active only in the operating region, in other words the region in which the operating guide acts in guiding manner, or only in the discharge region, in other words the region in which only the discharge guide acts in guiding manner. However, this solution is relatively complicated, because then, a corresponding transfer of the lifting apparatus must take place with the transfer between the two guides. Preferably, therefore, only one lifting apparatus is provided.

In this regard, the lifting apparatus can comprise a lifting cylinder, by means of which even great path distances and consequently correspondingly great guide lengths can be implemented in structurally simple manner. Other linear drives, particular, for example, a rack-and-pinion drive, cable hoists or other electric motor drives can also be provided for this purpose.

Preferably, the lifting cylinder or the lifting apparatus is not disposed in the operating guide plane; this brings about greater structural flexibility and, in particular, leaves sufficient construction space with regard to possible clamping devices or other elements having a clamping effect, as well as sufficient construction space with regard to the operating guide. Depending on the concrete implementation, a lower construction can certainly also be implemented in this manner.

It is understood that the characteristics of the solutions described above and in the claims can also be combined, if applicable, in order to be able to implement the advantages cumulatively, accordingly.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views:

FIG. 9 shows a part of the axial bearing of the ring-rolling machine according to FIGS. 1 to 8 in a schematic sectional view, with the axial bearing open;

FIG. 10 shows the arrangement according to FIG. 9 without the opening drive, in a section perpendicular to the drawing plane according to FIG. 9;

FIG. 11 shows the arrangement according to FIGS. 9 and 10, with the axial bearing closed, in a section identical to FIG. 9;

FIG. 12 shows the arrangement according to FIGS. 9 to 11 in a perspective view; and FIG. 13 shows the arrangement according to FIGS. 9 to 12 in a perspective view similar to FIG. 12, partially broken open.

DETAILED DESCRIPTION OF THE PREFERRED EMBODIMENT

Figure 1:
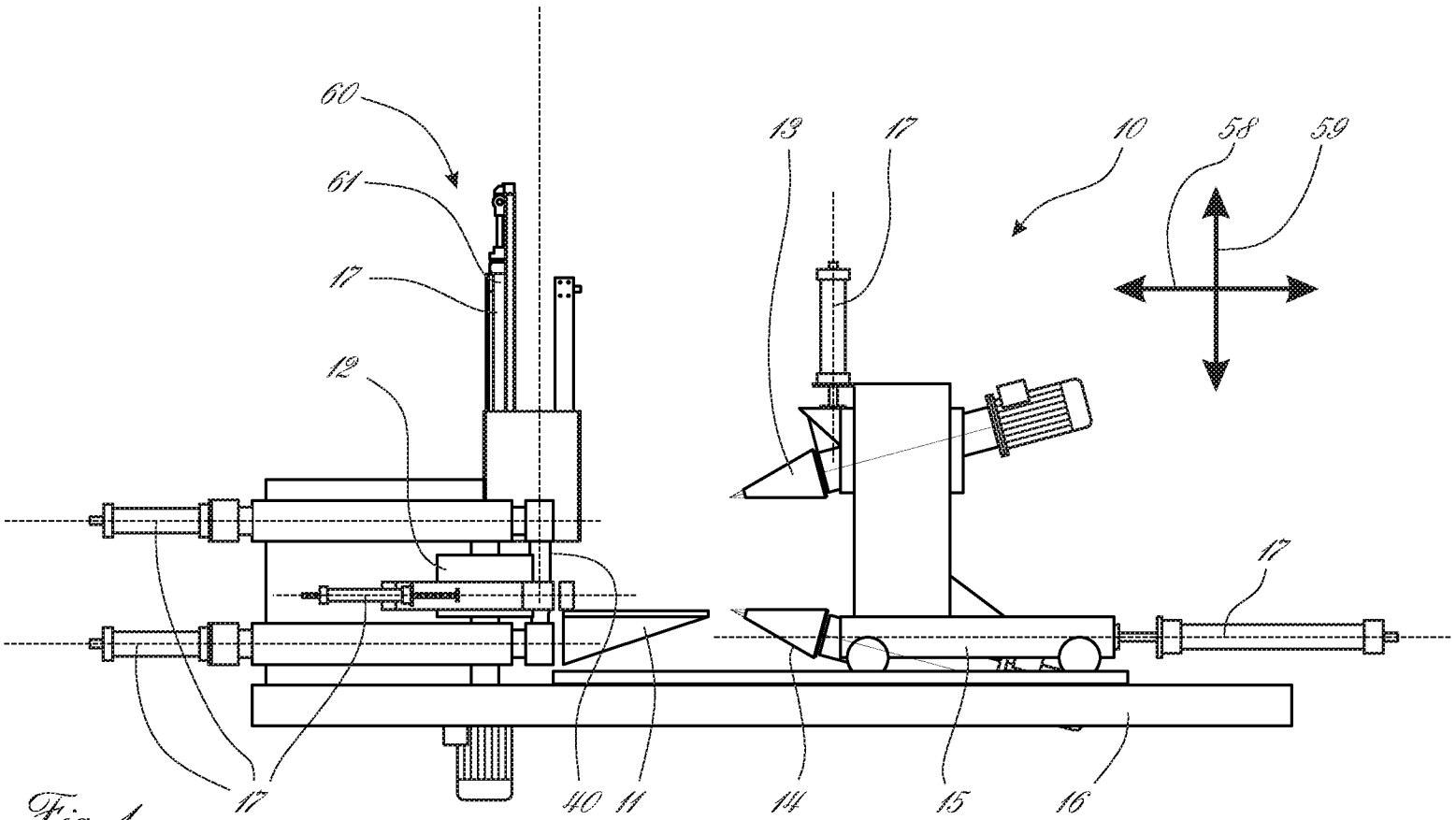
FIG. 1 shows a schematic side view of a ring-rolling machine.
Figure 4:
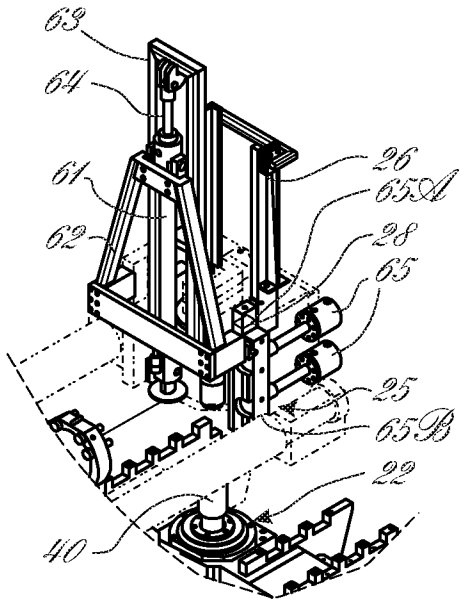
FIG. 4 shows the arrangement according to FIGS. 2 and 3 in a perspective view.
Figure 3:
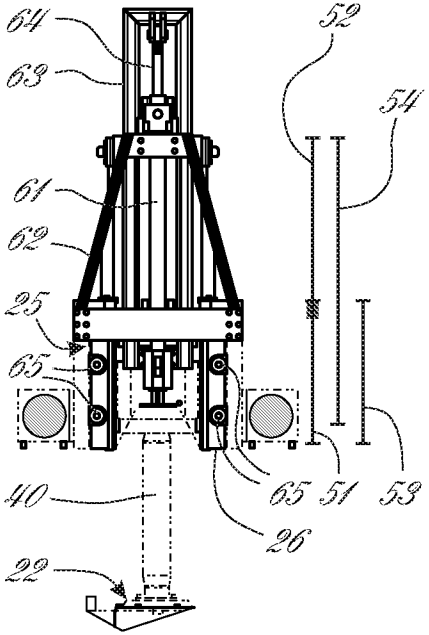
FIG. 3 shows a rear view of the arrangement shown in FIG. 2.

Referring in detail to the drawings, the ring-rolling machine 10 shown schematically as a whole in FIG. 1 has a mandrel roll 40 and a related radial roll 12, which can interact with one another in known manner to roll rings.

Furthermore, two axial rolls 13 and 14 are provided in a carriage 15 of the ring-rolling machine 10, wherein the carriage 15 can be set with reference to the radial roll 12, along a guide 16.

For the different adjustment possibilities, the ring-rolling machine 10 has a plurality of linear drives 17, which include a lifting apparatus 60 for the mandrel roll 40 or for a bearing body 24 that carries the mandrel roll 40.

The axial rolls 13, 14 can also be set relative to one another by way of one of the linear drives 17, for example, in that the upper axial roll 13 can be lowered and lifted. In this exemplary embodiment, the lower axial roll 14 remains in a vertical 59 position, which corresponds to a table 11 in terms of its height, on which table a ring to be rolled can slide.

Figure 2:
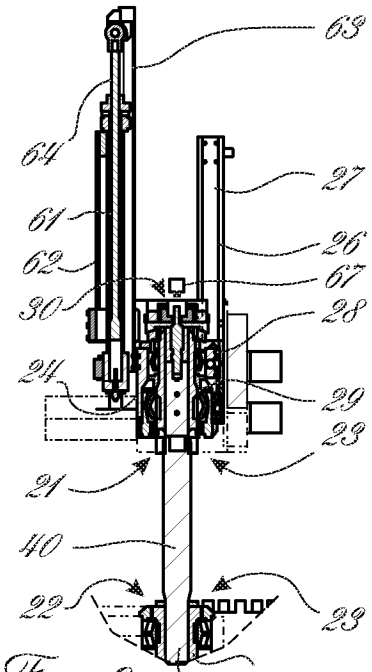
FIG. 2 shows a detail view of the operating guide and discharge guide of the arrangement according to FIG. 1, with the mandrel roll lowered, in section parallel to the drawing plane according to FIG. 1.
Figure 5:
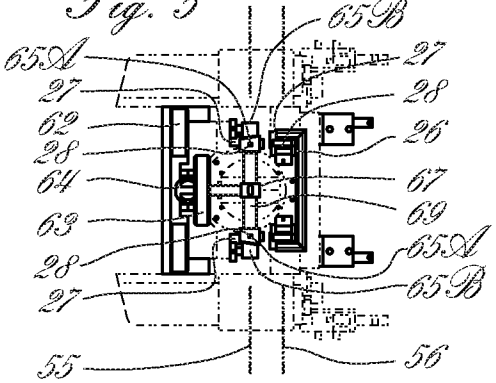
FIG. 5 shows the arrangement according to FIGS. 2 to 4 in a schematic view.
Figure 8:
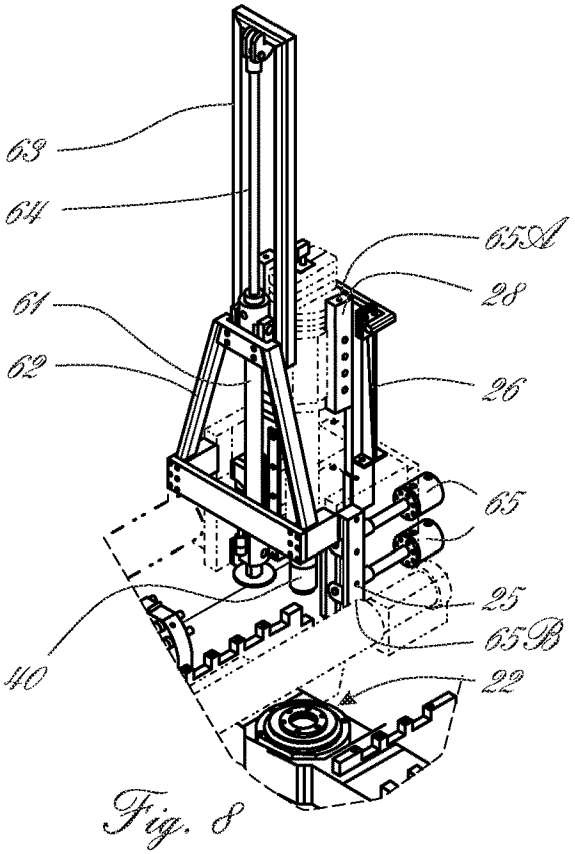
FIG. 8 shows the arrangement according to FIGS. 2 to 7 with the mandrel roll raised to a discharge position, in a similar representation as that of FIG. 4.
Figure 7:
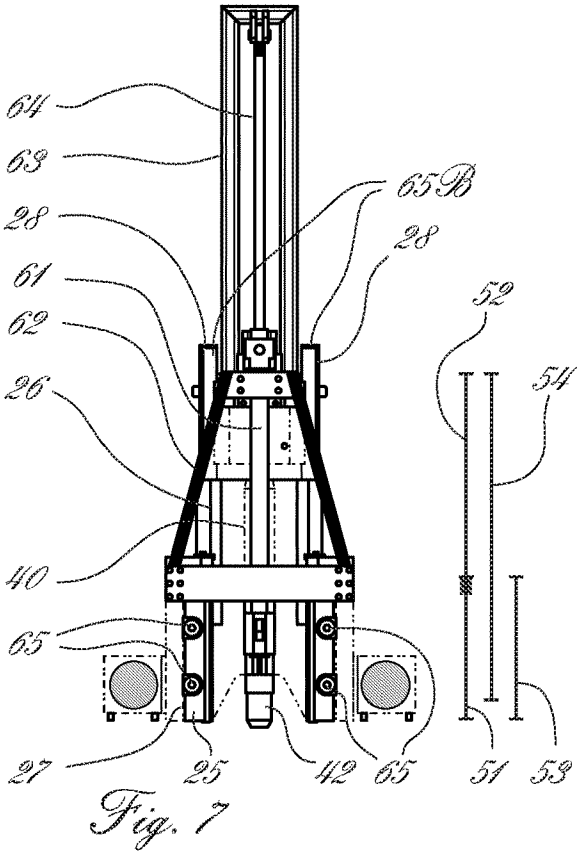
FIG. 7 shows the arrangement according to FIGS. 2 to 6 with the mandrel roll raised to a discharge position, in a similar representation as that of FIG. 3.
Figure 6:
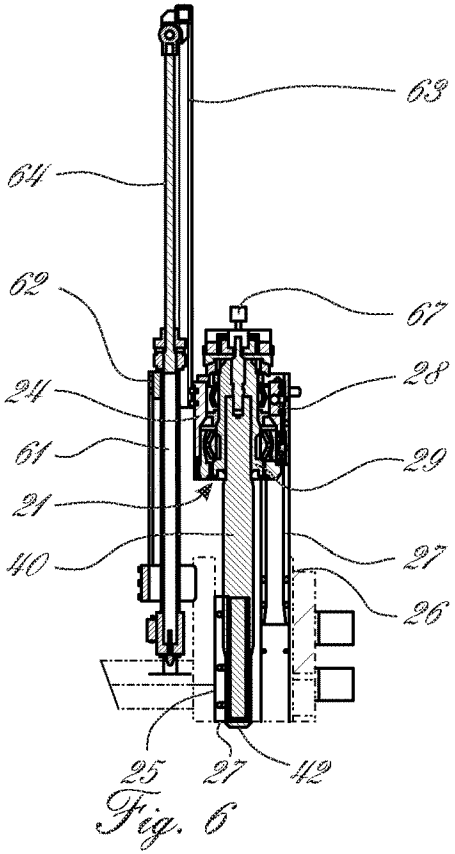
FIG. 6 shows the arrangement according to FIGS. 2 to 5 with the mandrel roll raised to a discharge position, in a similar representation as that of FIG. 2.

As is particularly evident from FIG. 2, the ring-rolling machine 10 has an upper mandrel roll bearing 21 and a lower mandrel roll bearing 22.

In this exemplary embodiment, the upper mandrel roll bearing 21 comprises both a radial bearing 23 and an axial bearing 30, which are provided on a bearing body 24, in each instance. In this regard, the upper mandrel roll bearing 21 serves as a fixed bearing in this exemplary embodiment. It is understood that in deviating embodiments, however, a different configuration can be selected.

The lower mandrel roll bearing 22 merely has a radial bearing 23 and serves as a floating bearing, wherein components of an axial bearing can also be provided on the lower mandrel roll bearing 22 in deviating embodiments, if necessary.

In the case of the present exemplary embodiment, the mandrel roll bearings 21, 22 are configured as roller bearings, in each instance, in which a bearing bushing 29 is mounted, at first, which bushing then encompasses the mandrel roll 40 radially in sufficiently tight manner. This makes it possible, on the one hand, for the mandrel roll 40 to be vertically displaced along the bearing bushing 29 of the lower mandrel roll bearing 22, so that it can be mounted at different vertical heights in different operating positions. On the other hand, the mandrel roll 40 can then also be removed from the mandrel roll bearings 21, 22 entirely; this is correspondingly advantageous for setup work, maintenance work, and the like, particularly for mandrel roll replacement.

The bearing body 24 can be displaced vertically 59 by means of the lifting apparatus 60, which comprises a lifting cylinder 61. For this purpose, the lifting cylinder 61 is held on the remainder of the ring-rolling machine 10 by way of a cylinder framework 62 in this exemplary embodiment, and vertically 59 drives a bearing body framework 63 by way of a lifting piston 64. The bearing body framework 63 is firmly connected with the bearing body 24, so that in this manner, vertical 59 displacement of the bearing body 24 is easily possible, as shown as examples in FIGS. 2 to 8. It is understood that in deviating embodiments, other lifting apparatuses 60 can also be provided, for example by means of cable hoists or by means of electric motor drives or the like.

For operationally reliable vertical displacement, the bearing body 24 is guided in a guide. This guide has an operating guide 25 and a discharge guide 26 in the present embodiment.

Both the operating guide 25 and the discharge guide 26 have guide elements 27 in the case of the present ring-rolling machine 10, which elements are provided on the bearing body 24 and interact with guide bodies 28 firmly disposed on the remainder of the ring-rolling machine 10. It is understood that if necessary, the guide elements 27 can also be provided indirectly on the bearing body 24, which body can also be configured in multiple parts, if necessary, if this appears to be required in deviating embodiments, as long as sufficient guidance can be guaranteed.

In the present embodiment, the guide elements 27 of the operating guide 25 are configured as guide rails, which interact with guide bodies 28 structured as rollers. It is understood that if necessary, other guide elements 27 or guide bodies 28, such as slide blocks, for example, can also be used, as long as sufficiently stable guidance is guaranteed.

Supplemental to the guide elements 27 of the operating guide 25, which are structured as guide rails, clamping elements 65B are furthermore provided, which can be displaced by way of clamping drives 65, in such a manner that the related guide bodies 28 can be clamped in place as clamping bodies 65A. In this manner, the bearing body 24 can be clamped in place by means of the clamping drives 65, in different operating positions along the operating guide 25, and consequently the mandrel roll 50 can be operated in operating positions at different vertical heights.

In the present ring-rolling machine 10, the guide bodies 28 of the discharge guide 26 are provided with rolling bodies, not numbered, which interact with guide elements 27 configured as guide rails, which elements extend upward, parallel to the lifting cylinder 61 and to the cylinder frameworks and bearing body frameworks 62, 63. This embodiment allows operationally reliable lifting and lowering in structurally simple manner, wherein here, too, a slide guide or the like is provided in deviating exemplary embodiments, if necessary.

As is directly evident, the operating guide 25 and the combination of clamping bodies 65A and clamping elements 65B allow vertical displacement of the bearing body 24 and consequently of the mandrel roll 40 over an operating region 51, while the discharge guide 26 allows vertical displacement over a discharge region 52, wherein the guide lengths 53, 54 of the two regions, the operating region and the discharge region 51, 52 overlap. In the overlap, the guide width of the operating guide 25 widens away from the operating region 51 toward the discharge region 52, so that in this manner, threading of the guide elements 27 of the operating guide 25 into the guide bodies 28 of the operating guide 25 can be easily guaranteed.

For the remainder, the operating guide 25 is selected to be narrower than the discharge guide 26 outside of the overlap region, and this particularly allows good threading of the mandrel roll 40 into the lower mandrel roll bearing 22 and stable guidance in the region of the clamping bodies 65A and clamping elements 65B. Then, the guide play until clamping can be reduced by way of the clamping drives 65, by means of the clamping bodies 65A and the clamping elements 65B.

Furthermore, in the present exemplary embodiment, the operating guide plane 55 and the discharge guide area 56, which is also configured as a plane, are disposed at a distance from one another, wherein the operating guide plane 55 intersects the mandrel roll 40 in the present exemplary embodiment. The latter brings about particularly stable and symmetrical guidance of the bearing body 24 and consequently also of the mandrel roll 40 in the operating region 51; ultimately, this is not necessary in the discharge region 52. Because of the fact that the operating guide plane 55 and the discharge guide area 56 are at a distance from one another, sufficient construction space remains, in each instance, for the respective modules of the operating guide 25 and of the discharge guide 26.

The guide bodies 28 of the operating guide 25, on the one hand, and of the discharge guide 26, on the other hand, can overlap viewed horizontally 58, and this accordingly saves construction space in the vertical 59 direction.

As can be seen in FIGS. 9 to 13, the axial bearing 30 has opening means 31 by means of which the axial bearing 30 can be opened and closed. This makes it possible to replace the mandrel roll 40 in fast and operationally reliable manner, wherein the axial bearing 30 encompasses a mandrel roll head 41 of the mandrel roll 40 in the present exemplary embodiment, and axially supports it from below and also from the top, in the present exemplary embodiment.

In this exemplary embodiment, the opening means 31 comprises locking elements, which are configured as a locking latch 35 and can be opened and closed counter to spring pressure of springs 38, by way of pushing jaws 37, wherein the pushing jaws 37 can be pressed against the locking latches 35 by way of a wedge 66 that can be displaced by means of an opening drive 67, so that the locking latches 35 can be displaced outward into an open position.

The locking latches 35 carry wear plates 68 on which an underside of the mandrel roll head 51 can come to rest, so that these wear plates 68 form latch contact points 34 of the locking latches 35.

However, the inclination angles of the wedges 66 and of the pushing jaws 37 as well as the contact surfaces of the latch contact points 34 of the locking elements and the contact surfaces of the locking elements 32 or of the locking latches 35 that are active at the bearing bushing 29 are dimensioned in such a manner that the locking elements are subject to a self-locking effect when the mandrel roll 40 rests on the latch contact points 34 of the locking latches 35. In this way, the opening drive 67 cannot open the opening means 31 or the locking latches 35 and consequently the axial bearing 30 if the mandrel roll 40 is hanging on the latch contact points 34 of the locking elements 32 or of the locking latches 35.

If, however, the mandrel roll 40 is supported from below, then the corresponding friction fit of the locking elements 32 or of the locking latches 35 opens, so that then, the pushing jaws 37 that are acted on by the wedge 66 and the opening drive 67 can open the locking latches 35 and consequently also the axial bearing 30.

Blocking latches 36 are also provided in the wedge 66 as blocking elements, which drop out of the wedge 66 when the pushing jaws 37 are open and prevent closing of the locking latches 35 and of the pushing jaws 37 by means of the springs 38. These blocking latches 36 have a latch contact point 34 on a guide rod, not numbered, which latch contact point 34 raises the blocking latches 36 again when a mandrel roll is inserted, so that the locking latches 35 or the locking elements can be closed by means of the spring 38.

In the present exemplary embodiment, the locking elements and the blocking elements are provided in a housing 70 that is affixed to the bearing bushing 29 and rotates with it. This allows particularly low-wear axial securing of the mandrel roll 40. The housing is in two parts and comprises a frame-like lower housing part 71 and a shell-like two-part upper housing part 72, thereby facilitating maintenance work and assembly work.

The bearing bushing 29 of the upper mandrel roll bearing 21 is mounted in the bearing body 24 both axially and radially, in fixed and rotatable manner. Thus, the mandrel roll 40 can be mounted in fixed manner by way of the bearing bushing 29, radially and axially, accordingly. Similar mounting also takes place for the bearing bushing 29 of the lower mandrel roll bearing 22, wherein the latter supports the mandrel roll 40 axially, as a floating bearing, due to lack of axial fixation of the mandrel roll 40.

The opening drive 67 is attached to the bearing body 24 by means of an opening drive support 69, and consequently does not rotate along with the housing 70 of the axial bearing 30 or with the mandrel roll 40. This allows opening of the axial bearing 30 without complex ducts, particularly without hydraulic ducts. Slide contacts might still be required, for example in order to electronically monitor the position of the latches, but this does not require any great currents and voltage and can be done wirelessly, if necessary, for example by means of RFID technology.

For opening, the opening drive 67 acts on a drive plate 39, which is made available by the base of the wedge 66 in this exemplary embodiment.

Accordingly, while only a few embodiments of the present invention have been shown and described, it is obvious that many changes and modifications may be made thereunto without departing from the spirit and scope of the invention.

REFERENCE SYMBOL LIST

10 ring-rolling machine
11 table
12 radial roll
13 upper axial roll
14 lower axial roll
15 carriage
16 guide
17 linear drive
21 upper mandrel roll bearing
22 lower mandrel roll bearing
23 radial bearing
24 bearing body
25 operating guide
26 discharge guide
27 guide element
28 guide body
29 bearing bushing
30 axial bearing
31 opening means
34 latch contact point
35 locking latch
36 blocking latch
37 pushing jaw
38 spring
39 drive plate
40 mandrel roll
41 mandrel roll head
42 mandrel roll foot
51 operating region
52 discharge region
53 guide length of the operating guide 25
54 guide length of the discharge guide 26
55 operating guide plane
56 discharge guide area
58 horizontal(ly)
59 vertical(ly)
60 lifting apparatus
61 lifting cylinder
62 cylinder framework
63 bearing body framework
64 lifting piston
65 clamping drive
65A clamping body
65B clamping element
66 wedge
67 opening drive
68 wear plate
69 opening drive support
70 housing
71 lower housing part
72 upper housing part

What is claimed is:

1. A ring-rolling machine comprising:

a mandrel roll mounted in an upper and a lower mandrel roll bearing, a lifting apparatus for lifting the mandrel roll, pushing jaws, a radial roll related to the mandrel roll, and an opening element comprising locking latches and a wedge, the wedge comprising blocking latches, wherein the upper mandrel roll bearing is configured as a fixed bearing, the fixed bearing has both a radial bearing and an axial bearing, the axial bearing encompasses a mandrel roll head of the mandrel roll and supports the mandrel roll at a bottom, the axial bearing is configured so that it can be opened by way of the opening element, the locking latches prevent opening of the axial bearing if the mandrel roll is not supported from below, the blocking latches prevent closing of the axial bearing if no mandrel roll is present in a region of the axial bearing, the pushing jaws are pressed against the locking latches via the wedge to displace the locking latches outward into an open position to open the axial bearing when the mandrel roll is supported from below, and the locking latches have a locking effect by way of force fit or friction fit and are separate from the pushing jaws.

2. The ring-rolling machine according to claim 1, wherein the locking latches have at least one latch contact point on which the mandrel roll comes to rest.

3. The ring-rolling machine according to claim 1, wherein the opening element comprises an opening drive that does not rotate along with the mandrel roll, said opening drive being configured to act on a drive plate that opens the axial bearing and rotates along with the mandrel roll.

4. A method for lifting and lowering a mandrel roll of a ring-rolling machine, the ring-rolling machine being according to claim 1, the method comprising:

displacing the mandrel roll so as to lift and lower the mandrel roll, opening the axial bearing by way of the opening element, preventing, via the locking latches, opening of the axial bearing if the mandrel roll is not supported from below, and preventing, via the blocking latches, closing of the axial bearing if no mandrel roll is present in the region of the axial bearing.

5. A method for lifting and lowering a mandrel roll of a ring-rolling machine, the ring-rolling machine being according to claim 1 and further comprising a bearing body, an operating guide, and a discharge guide, the upper mandrel roll bearing being disposed on the bearing body, the method comprising:

displacing the mandrel roll so as to lift and lower the mandrel roll, guiding the bearing body by way of the operating guide, vertically in a vertical operating region, guiding the bearing body by way of the discharge guide in a vertical discharge region, and transferring guidance of the bearing body between the operating guide and the discharge guide when the bearing body departs from the vertical operating region or enters back into the vertical operating region.

6. A method for lifting and lowering a mandrel roll of a ring-rolling machine, the ring-rolling machine being according to claim 1 and further comprising a bearing body and a discharge guide, the upper mandrel roll bearing being disposed on the bearing body, the method comprising:

displacing the mandrel roll so as to lift and lower the mandrel roll, guiding, via the discharge guide, the bearing body in a vertical discharge region, and clamping the bearing body in place during operation.

7. The method according to claim 4, wherein the opening element includes an opening drive that does not rotate along with the mandrel roll or wherein the axial bearing is opened by inserting the mandrel roll into the axial bearing.

8. The ring-rolling machine according to claim 1, wherein the wedge is disposed at a wedge inclination angle, wherein the pushing jaws are disposed at a pushing jaw inclination angle, and wherein the wedge inclination angle and the pushing jaw inclination angle are dimensioned so that the locking latches are subject to a self-locking effect, the wedge inclination angle is obtuse, or the locking latches are subject to a self-locking effect and the wedge inclination angle is obtuse.

* * * * *